United States Patent [19]

Uno

[11] Patent Number: 4,499,825

[45] Date of Patent: Feb. 19, 1985

[54] INK WIPING DEVICE FOR INTAGLIO ROTARY PRINTING MACHINES

[75] Inventor: Chiyomatsu Uno, Saitama, Japan

[73] Assignee: Komori Printing Machinery Co., Ltd., Tokyo, Japan

[21] Appl. No.: 447,880

[22] Filed: Dec. 8, 1982

[30] Foreign Application Priority Data

Dec. 12, 1981 [JP] Japan ..... 56-200564

[51] Int. Cl.[3] ..... B41F 9/08

[52] U.S. Cl. ..... 101/167; 101/155; 101/156; 101/168; 101/425; 118/203; 15/256.51

[58] Field of Search ..... 101/156, 157, 167, 168, 101/169, 425, 155, 161; 15/256.5, 256.51, 256.52; 118/104, 203

[56] References Cited

U.S. PATENT DOCUMENTS

| | | | |
|---|---|---|---|
| 1,082,586 | 12/1913 | Georges et al. | 101/167 |
| 1,511,307 | 10/1924 | Smith | 101/156 |
| 1,733,252 | 10/1929 | Eriksen | 101/156 |
| 1,927,056 | 9/1933 | Aitchison | 101/156 |
| 3,656,431 | 4/1972 | Giori | 101/167 |
| 4,137,597 | 2/1979 | Achenbach et al. | 15/256.51 |
| 4,232,604 | 11/1980 | Waizmann | 101/425 |

*Primary Examiner*—Edgar S. Burr
*Assistant Examiner*—David A. Wiecking
*Attorney, Agent, or Firm*—Thompson, Birch, Gauthier & Samuels

[57] ABSTRACT

An ink wiping device for an intaglio rotary printing machine comprises a tank for containing a cleaning liquid therein, an ink wiping roller rotatably supported in the tank and having a circumferential surface positioned for rolling contact with a printing plate of the intaglio rotary printing machine, the ink wiping roller having a portion immersible in the cleaning liquid, and a cleaning assembly disposed in the tank and immersible in the cleaning liquid for cleaning the circumferential surface of the ink wiping roller. The cleaning assembly includes at least one brush unit adjustably supported in the tank and having a plurality of rows of bristles having distal ends located in the vicinity of the circumferential surface of the ink wiping roller, and a cleaning sheet of synthetic fibered nonwoven cloth supported on the brush unit and interposed between the circumferential surface of the ink wiping roller and the distal ends of the bristles. Ink that has been removed and transferred from the printing plate to the ink wiping roller is wiped off the latter by the cleaning sheet pressed against the ink wiping roller under the resiliency of the bristles, and is dissolved into the cleaning solution.

3 Claims, 7 Drawing Figures

INK WIPING DEVICE FOR INTAGLIO ROTARY PRINTING MACHINES

BACKGROUND OF THE INVENTION

The present invention relates to an ink wiping device for wiping or scraping off excess ink from the plate surface in an intaglio rotary printing machine.

In intaglio printing, ink is applied by an inking device to the intaglio printing plate wrapped around a intaglio cylinder, and excess ink on the non-printing areas of the intaglio printing plate is removed by a wiping roller which rotates against the intaglio printing plate, leaving ink only in the grooves cut in the intaglio printing plate according to a pattern to be printed. For making a print, a sheet of paper is fed between the plate cylinder and an impression cylinder pressed thereagainst to allow the ink to be transferred from the pattern grooves onto the sheet of paper. The ink wiping roller is rotatably immersed in a cleaning solution such as trichlorethylene contained in a tank. A plurality of brushes extend axially along the ink wiping roller in contact with the circumferential surface of the ink wiping roller in the cleaning solution. The ink as it is wiped off the intaglio printing plate and transferred to the wiping roller is removed from the latter by the brushes and the cleaning solution, and dissolved into the cleaning solution in the tank.

Various brush and scraper constructions are known for use in the ink wiping device. One form is composed of a plurality of rows of brushes fixed to a bracket disposed below the ink wiping roller and having brush ends held against the circumferential surface of the ink wiping roller. Another construction comprises a circular brush rotatably held against the ink wiping roller. According to still another proposal, the ink is wiped off by a scraper of hard rubber placed against the ink wiping roller. The fixed and rotatable brushes however are disadvantageous in that their ends contacting the ink wiping roller remain coarse in density and cannot wipe off the ink sufficiently as linear brush marks are left on the ink wiping roller as it rotates, a limitation which could not be eliminated if the bristles were denser. The brushes are forced to bend at all times in the direction of rotation of the ink wiping roller, and tend to be less resilient and thus wear rapidly, with the results that the brushes will prove less durable and less stable in operation. The rotatable brushes have additional difficulties in that they are more liable to retain dirt, they are difficult to serice and they agitate the cleaning solution which becomes turbid and ends up with reduced cleaning power. With the scraper, the cleaning solution is less effective to clean the ink wiping roller when the scraper scrapes the ink off the ink wiping roller. To cope with this, it is necessary that scrapers be located at different positions around the ink wiping roller along the direction of rotation thereof. However, it would be highly costly to do so, and moreover there is insufficient space to accommodate a plurality of scrapers.

SUMMARY OF THE INVENTION

Accordingly, it is an object of the present invention to provide an ink wiping device which is simple in construction, easy to service, and capable of scraping off ink completely from an ink wiping roller without leaving residual ink thereon.

According to the present invention, an ink wiping device for an intaglio rotary printing machine comprises a cleaning assembly immersed in a cleaning liquid contained in a tank and held against an ink wiping roller for wiping ink off a intaglio printing plate, the cleaning assembly including at least one brush unit having a plurality of rows of bristles and a cleaning sheet of synthetic fibered nonwoven cloth and interposed between the circumferential surface of the ink wiping roller and distal ends of the bristles for being pressed in face-to-face engagement against the circumferential surface of the ink wiping roller under the resiliency of the bristles., Ink that has been removed and transferred from the intaglio printing plate to the ink wiping roller can be wiped off the latter by the cleaning sheet and dissolved into the cleaning solution in the tank.

The above and other objects, features and advantages of the present invention will become more apparent from the following description when taken in conjunction with the accompanying drawings in which a preferred embodiment of the present invention is shown by way of illustrative example.

BRIEF DESCRIPTION OF THE DRAWINGS

FIG. 4(*b*) is a cross-sectional view of a main brush support;

FIG. 5(*b*) is a fragmentary cross-sectional view of the mechanism shown in FIG. 5(*a*).

DETAILED DESCRIPTION

Figure 1:
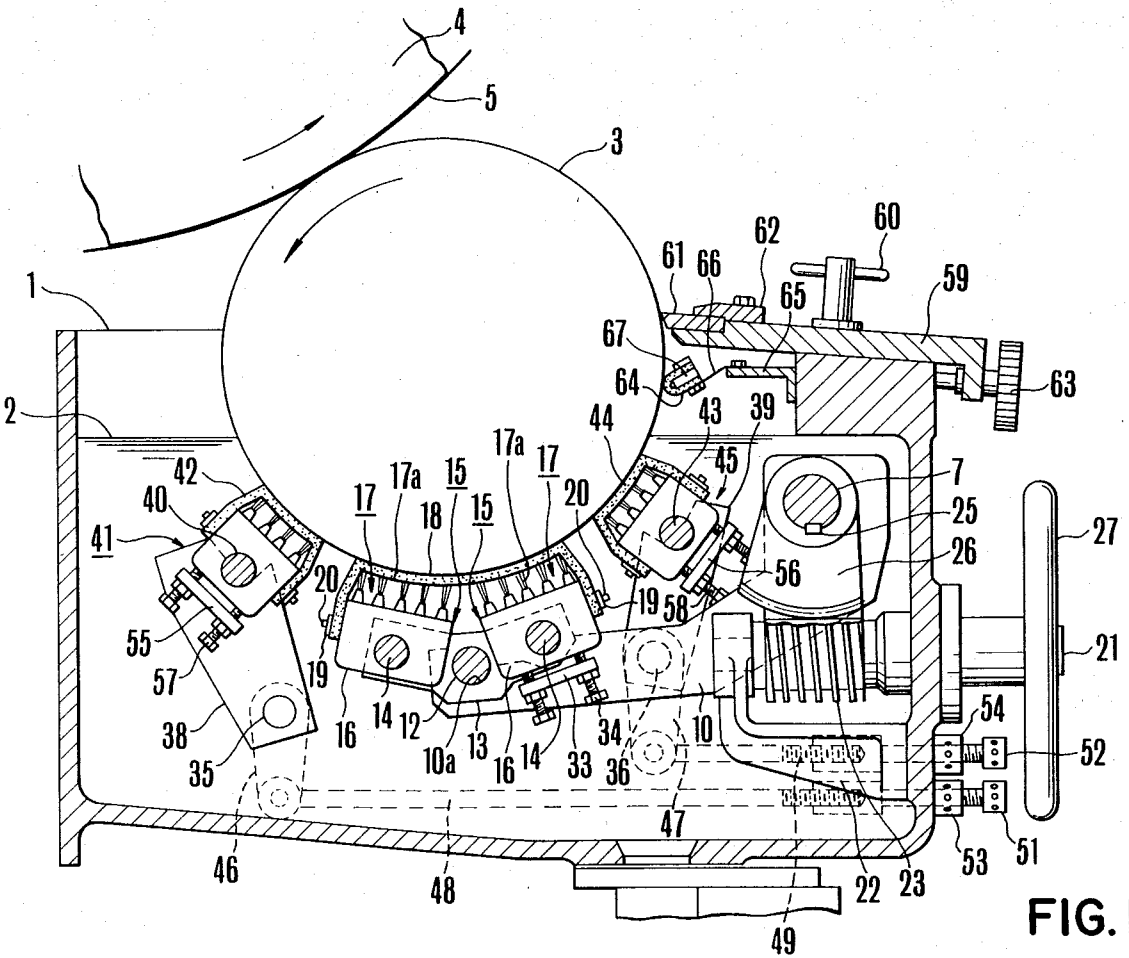
FIG. 1 is a cross-sectional view of an ink wiping device for an intaglio rotary printing machine according to the present invention.

As shown in FIG. 1, an ink wiping roller 3 is rotatably supported with its lower portion immersed in a cleaning liquid 2 in a tank 1. The ink wiping roller 3 has its circumferential surface held against a printing plate 5 mounted on a plate cylinder 4, the ink wiping roller 3 and the plate cylinder 4 being rotatable in opposite directions. An arm support shaft 7 is mounted in the tank 1 for angular movement about its own axis with its ends sealed by packings 6 (FIG. 4(*a*)), and has both ends journalled in bushings 8 fitted in opposite sidewalls of the tank 1 and an intermediate portion journalled in a bearing 9 fixed to a sidewall of the tank 1. A pair of swing arms 10 are fixed by bolts 11 to the arm support shaft 7 and have free ends positioned respectively below both ends of the ink wiping roller 3. The free ends of the swing arms 10 have semicircular bearings 10*a* in which there is supported a brush support shaft 12 for angular movement about its own axis, the brush support shaft 12 being slightly longer than the ink wiping roller 3. The brush support shaft 12 supports fixedly on its ends a pair of brush supports 13 adjacent respectively to the swing arms 10, the brush supports 13 each being of a substantially arcuate configuration extending along the circumferential surface of the ink wiping roller 3. A pair of brush shafts 14 extend between and are supported by the brush supports 13.

A pair of main brushes 15 include holders 16 fixed to the brush shafts 14 and brush units 17. Each of the brush units 17 comprises a base extending axially of the ink wiping roller 3 and a plurality of rows of bristles 17*a* having ends embedded in the base and distal ends located near the circumferential surface of the ink wiping roller 3. A wiper pad 18, which is in the form of a synthetic fibered nonwoven cloth sheet made of such as nylon, covers the main brushes 15 fully over their surfaces and is interposed between the bristles 17*a* and the circumferential surface of the ink wiping roller 3. The wiper pad 18 has lateral ends bent over and fastened to sides of the brush units 17 by plates 19 and bolts 20.

Figure 2:
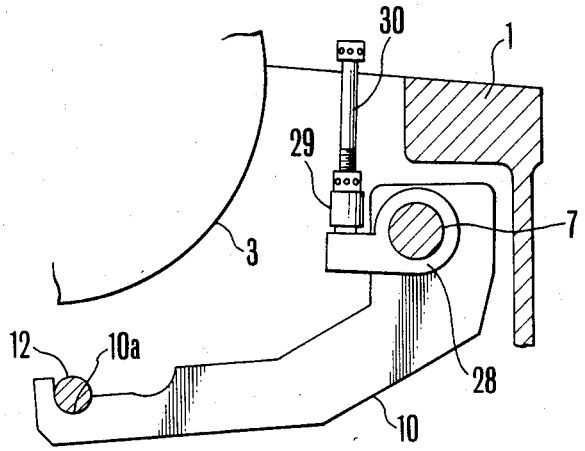
FIG. 2 is a side elevational view of a main brush support.

The main brushes 15 are pressable against the ink wiping roller 3 with a pressure adjustable by a pressure adjusting mechanism. The pressure adjusting mechanism has a worm shaft 21 rotatably supported by the sidewall of the tank 1 and a bracket 22 affixed to the tank sidewall, a worm 23 fixedly disposed around the worm shaft 21, and a sector-shaped worm wheel 26 fixed by a key 25 to the arm support shaft 7 and retained by collars 24 against axial displacement on the arm support shaft 7, the worm 23 being held in driving mesh with the worm wheel 26. The worm shaft 21 has an end projecting out of the tank 1, and a handle 27 is mounted on the projecting end of the worm shaft 21. By turning the handle 27, the swing arm 10 is caused by the worm 23 and the worm wheel 26 to swing about the arm support shaft 7 for adjusting the pressure with which the wiper pad 18 covering the main brushes 15 is held against the ink wiping roller 3. As shown in FIG. 2, a stop lever 28 is fixed to the arm support shaft 7 and has an end portion disposed in confronting relation to an end of an adjustment bolt 30 threaded through a stud 29 mounted on the tank 1 for axial back-and-forth movement. Turning movement of the adjustment bolt 30 determines an upper limit for angular movement of the swing arm 10 in order to prevent the main brushes 15 from being pressed against the ink wiping roller 3 under excessive pressure.

Figure 3:
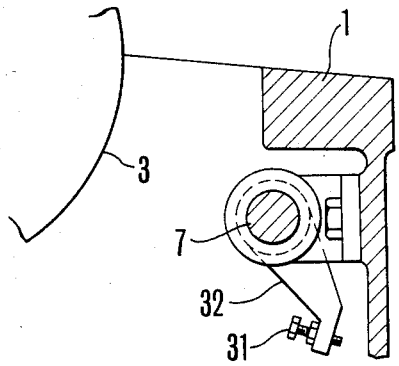
FIG. 3 is a side elevational view of a main brush stop.
Figure 4A:
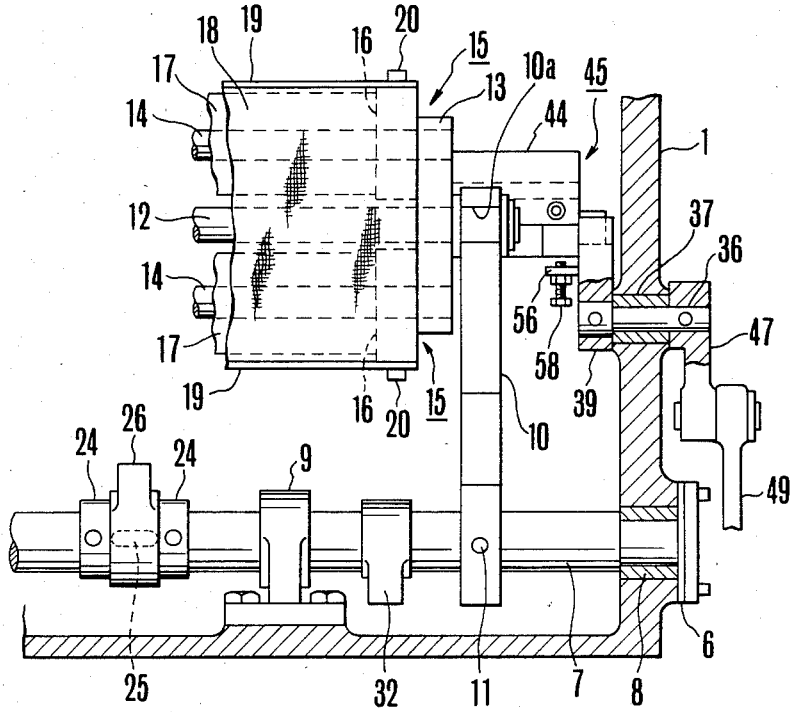
FIG. 4(*a*) is a fragmentary plan view of main brushes and associated parts.
Figure 4B:
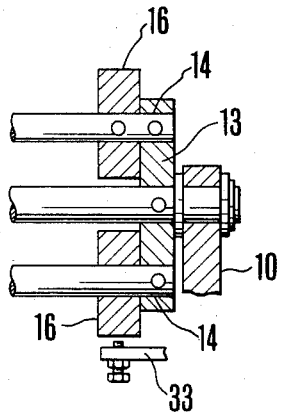

As illustrated in FIGS. 3 and 4(*a*), a stop 32 with an adjustment bolt 31 is mounted on the arm support shaft 7 for preventing the swing arm 10 from turning excessively counterclockwise (FIGS. 1 and 3) about the arm support shaft 7. The swing arm 10 has near its distal end an auxiliary plate 33 projecting therefrom and supporting a pair of adjustment bolts 34 threaded therethrough and having distal ends abutting against one of the holders 16. The angle of inclination of brush support 13 can be adjusted by turning the adjustment bolts 34 acting on the holder 16.

Two pairs of pivot shafts 35, 36 are journalled by bushings 37 fitted in the sidewalls of the tank 1 obliquely below the ink wiping roller 3. The pivot shafts 35, 36 have ends projecting into the tank 1 and supporting two pairs of brush arms 38, 39, respectively, fixed thereto. The pair of brush arms 38 have semicircular bearings defined in their upper ends and supporting a brush shaft 40 extending therebetween for angular movement about its own axis. A front brush 41, which is of the same construction as that of each of the main brushes 15, is fixed to the brush shaft 40 and is covered with a wiper pad 42 held against the circumferential surface of the ink wiping roller 3, the wiper pad 42 being of the same construction as that of the wiper pad 18 except for its dimensions. A brush shaft 43 is also supported on bearings on the pair of brush arms 39, and a rear brush 45 with a wiper pad 44 is fixed to the brush shaft 43, the rear brush 45 being identical in construction with the front brush 41.

Figure 5A:
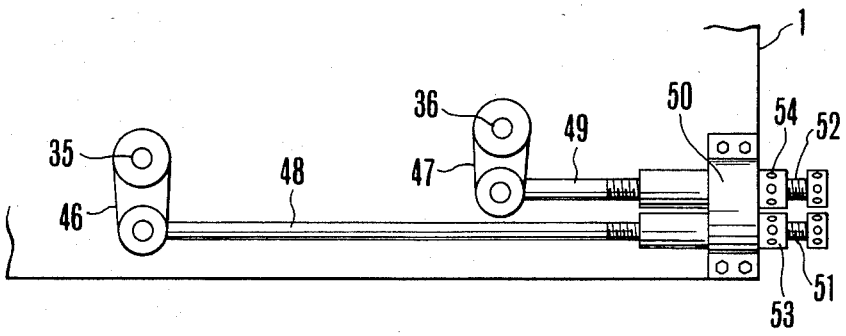
FIG. 5(*a*) is side elevational view of a mechanism for adjusting swinging movement of a front brush and a rear brush.
Figure 5B:
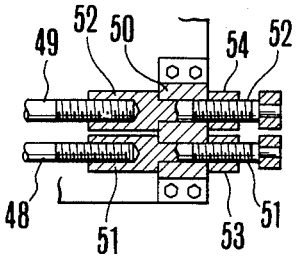

The front and rear brushes 41, 45 are provided with mechanisms for adjusting the pressure with which they are pressed against the ink wiping roller 3. More specifically, the pivot shafts 35, 36 have ends projecting out of the tank 1, to which there are secured levers 46, 47, respectively, pivotably supporting rods 48, 49 having threaded ends threaded in internally threaded holes in adjustment screws 51, 52, respectively, supported in a bearing 50 mounted on a corner of the tank 1. When the adjustment screws 51, 52 are turned with lock nuts 53, 54 loosened while preventing axial movement, the rods 48, 49 are longitudinally moved in one direction or the other with their threaded portions axially driven in the internal threaded holes in the adjustment screws 51, 52, as shown in FIGS. 5(*a*) and 5(*b*). Therefore, the front and rear brushes 41, 45 can be pressed against the ink wiper roller 3 under pressures independently adjusted through the levers 46, 47 and the brush arms 38, 39. The brush arms 38, 39 have auxiliary plates 55, 56 projecting respectively therefrom and having adjustment bolts 57, 58 with their distal ends bearing against the brushes 41, 45, respectively. Turning movement of the adjustment bolts 57, 58 can independently adjust the angle of inclination of the front and rear brushes 41, 45 with respect to the ink wiping roller 3.

A doctor 59 is fixed to an upper surface of the tank 1 by a bolt with a handle 60. The doctor 59 includes a doctor blade 61 of hard rubber fastened to its distal end by a holder 62 and having a distal edge held against the circumferential surface of the ink wiping roller 3 for scraping off the cleaning liquid 2 from the ink wiping roller 3. The doctor 59 can be moved back and forth by turning a handle 63 while loosening the handle 60 to thereby adjust the clearance between the doctor blade 61 and the ink wiping roller 3. Below the doctor blade 61, there is disposed a pad 64 of synthetic fibered nonwoven cloth supported on a holder 67 mounted by a leaf spring 66 on a bracket 65 fixed to the tank 1 for blocking off the cleaning liquid 2 which tends to be carried by the ink wiping roller 3 as it rotates.

The ink wiping device thus constructed will operate as follows: The printing plate 5 on the plate cylinder 4 is inked by an inking device (not shown) of a known construction, and then ink on the non-printing areas is removed by and transferred to the ink wiping roller 3 rotating in a direction opposite to that of rotation of the plate cylinder 4, leaving ink only in the grooves cut in the plate 5 according to a pattern or design to be printed. With the ink wiping roller 3 having its lower portion immersed in the cleaning liquid 2 and held in contact with the wiper pads 42, 18, 44 covering the brushes 41, 15, 15, 45, the ink attached to the circumferential surface of the ink wiping roller 3 is removed therefrom by being dissolved into the cleaning solution 2 impregnated in the wiper pads 42, 18, 44 and also by the wiper pads 42, 18, 44 themselves pressed against the ink wiping roller 3. After the ink has been removed, the cleaning liquid 2 carried on the ink wiping roller 3 as it rotates is scrapped off by the pad 64 and the doctor blade 61. The ink wiping roller 3 thus can continue to wipe ink off the plate 5.

The pressure with which the brushes are held against the ink wiping roller 3 can be adjusted in the following manner: By turning the handle 27, the swing arm 10 is angularly moved about the arm support shaft 7 through the worm 23 and the worm wheel 26 to allow the main brushes 15 to be pressed against the ink wiping roller 3 under an adjusted pressure. When the adjustment bolts 34 are turned, the brush support 13 can angularly be moved about the brush support shaft 12 until the main brushes 13 are equally pressed against the ink wiping roller 3. Turning movement of the adjustment bolts 51, 52 located outside of the tank 1 causes the brush arms 38, 39 to swing about the pivot shafts 35, 36 for thereby adjusting the force with which the front and rear brushes 41, 45 are held against the ink wiping roller 3. By turning the adjustment bolts 57, 58, the brushes 41, 45 are angularly moved about the shafts 40, 43 so as to be inclined with respect to the ink wiping roller 3 for uniform engagement therewith.

The ink wiping roller 3 can be cleaned effectively by the wiper pads 18, 42, 44 that are backed up by brush units 17 with the bristles 17*a* and the similar brushes 41, 45. Each of the wiper pads 18, 42, 44 is made of nonwoven fabric of synthetic fibers which are cut, piled randomly, and held together by adhesive, and is permeable to liquids. The wiper pads 18, 42, 44 of high density are held in face-to-face contact with the circumferential surface of the ink wiping roller 3. The cleaning liquid 2 is fully impregnated in the wiper pads 18, 42, 44, and can seep out of their contacting surfaces to wipe the ink completely off the circumferential surface of the ink wiper roller 3. Since the wiper pads 18, 42, 44 are resilient per se, and backed up by the bristles 17*a*, which are bent under pressure and hence springy or resilient, the wiper pads 18, 42, 44 are held in contact with the circumferential surface of the ink wiping roller 3 under highly uniform pressure for improved ink scraping and cleaning capability.

With the foregoing arrangement of the present invention, the wiper pads 18, 42, 44 impregnated with the cleaning solution are held in uniform, face-to-face contact with the circumferential surface of the ink wiping roller 3 through a suitable degree of cushioning provided by the resiliency of the wiper pads per se and the resiliency of the bristles 17*a* for wiping the ink off the circumferential surface of the ink wiping roller 3. The ink wiping roller 3 can therefore be cleaned highly uniformly without leaving any ink deposit thereon. With the wiper pads pressed resiliently in face-to-face engagement against the ink wiping roller 3, there is no danger for the circumferential surface thereof to be worn rapidly and damaged. The ink wiping roller 3 can retain its dimensional accuracy and is durable in operation. The ink wiping device of the invention is of a simple structure, can be economically constructed, and can be serviced with ease as no wear is caused on the bristles 17*a*.

Although a certain preferred embodiment has been shown and described, it should be understood that many changes and modifications may be made therein without departing from the scope of the appended claims.

What is claimed is:

1. An ink wiping device for an intaglio rotary printing machine having a plate cylinder supporting an intaglio printing plate wrapped therearound, comprising:

a tank for containing a cleaning solution therein;

an ink wiping roller rotatably supported in said tank and having a circumferential surface positioned for rolling contact with the printing plate, said ink wiping roller having a portion of said circumferential surface immersed in the cleaning solution; and a cleaning assembly for cleaning said circumferential surface, said cleaning assembly being entirely immersed in the cleaning solution and including at least one brush unit adjustably supported in said tank, said brush unit having multiple rows of bristles arranged such that their distal ends confront an arcuate sector of the immersed portion of said circumferential surface, and a cleaning sheet of synthetic nonwoven cloth secured to and fixed relative to said brush unit, said sheet being supported on and resiliently pressed by said bristles against and into conformity with said arcuate sector.

2. An ink wiping device according to claim 1, including an arm support shaft disposed in said tank, a pair of swing arms swingably mounted on said arm support shaft, said at least one brush unit including a pair of main brush units angularly movably supported on said swing arms remotely from said arm support shaft and extending axially of said ink wiping roller, said cleaning sheet being supported on each of said main brush units, a mechanism mounted on said tank for angularly moving said swing arms about said arm support shaft to adjust the pressure with which said cleaning sheet is held against said circumferential surface of said ink wiping roller.

3. An ink wiping device according to claim 2, including pivot shafts supported on said tank for angular movement about their own axes, brush arms mounted on said pivot shafts, said at least one brush unit further including a pair of front and rear brush units mounted on said brush arms, respectively, and disposed one on each side of said main brush unit with respect to the direction of rotation of said ink wiping roller, said cleaning sheet being supported on each of said front and rear brush units, and a pair of mechanisms mounted on said tank for angularly moving said brush arms to adjust the pressure with which said cleaning sheet is held against said circumferential surface of said ink wiping roller.

* * * * *